US008596456B2

(12) United States Patent
Birgers et al.

(10) Patent No.: US 8,596,456 B2
(45) Date of Patent: Dec. 3, 2013

(54) DISPLAY APPARATUS

(75) Inventors: Christopher J. Birgers, Cupertino, CA (US); Michael Joseph Solomon, Foster City, CA (US)

(73) Assignee: Apple Inc., Cupertino, CA (US)

( * ) Notice: Subject to any disclaimer, the term of this patent is extended or adjusted under 35 U.S.C. 154(b) by 161 days.

(21) Appl. No.: 12/950,875

(22) Filed: Nov. 19, 2010

(65) Prior Publication Data

US 2012/0125810 A1 May 24, 2012

(51) Int. Cl.
*B65D 73/00* (2006.01)

(52) U.S. Cl.
USPC ..... 206/490; 206/486; 206/524.8

(58) Field of Classification Search
USPC ..... 206/461, 471, 486, 490, 775, 779, 769, 206/531, 532, 538, 524.8
See application file for complete search history.

(56) References Cited

U.S. PATENT DOCUMENTS

| | | | | |
|---|---|---|---|---|
| 3,047,144 | A * | 7/1962 | Wissel | 206/0.83 |
| 3,172,768 | A * | 3/1965 | Joosten et al. | 426/106 |
| 5,033,616 | A * | 7/1991 | Wyser | 206/704 |
| 5,191,972 | A * | 3/1993 | Helzer et al. | 206/0.84 |
| 5,343,861 | A * | 9/1994 | Herman | 600/406 |
| 5,560,490 | A * | 10/1996 | Chawla | 206/539 |
| 6,364,115 | B1 * | 4/2002 | Casanova et al. | 206/471 |
| 6,588,180 | B2 * | 7/2003 | Heath et al. | 53/440 |
| 6,596,374 | B1 * | 7/2003 | Adjeleian | 428/131 |
| 7,328,801 | B2 * | 2/2008 | Iossi | 206/531 |
| 7,677,389 | B2 | 3/2010 | Czopor, Jr. et al. | |
| 7,735,678 | B2 | 6/2010 | Rushe et al. | |
| 2002/0104773 | A1 * | 8/2002 | Kalvelage et al. | 206/538 |
| 2003/0047474 | A1 | 3/2003 | Dahlson | |
| 2003/0150770 | A1 | 8/2003 | Campbell et al. | |
| 2004/0206653 | A1 * | 10/2004 | Filion | 206/461 |
| 2005/0218027 | A1 * | 10/2005 | Lammers et al. | 206/467 |
| 2008/0313953 | A1 * | 12/2008 | Pettigrew et al. | 43/131 |

FOREIGN PATENT DOCUMENTS

| | | | |
|---|---|---|---|
| JP | 2003-192055 | A | 7/2003 |
| NL | 1008884 | C1 | 10/1999 |

OTHER PUBLICATIONS

International Search Report and Written Opinion for International Application No. PCT/US2011/059738, European Patent Office, Netherlands, mailed on Jan. 12, 2012.

U.S. Appl. No. 29/379,534, Birgers et al., "Display Apparatus", filed Nov. 19, 2010.

* cited by examiner

*Primary Examiner* — David Fidei

(74) *Attorney, Agent, or Firm* — Sterne, Kessler, Goldstein & Fox P.L.L.C.

(57) ABSTRACT

The present invention includes a display apparatus including an item retention wall defining a cavity, and a suspension member coupled to the item retention wall, wherein the item retention wall is configured to retain an item within the cavity by a retention seal between the item and the item retention wall.

19 Claims, 12 Drawing Sheets

DISPLAY APPARATUS

BACKGROUND OF THE INVENTION

1. Field of the Invention

The present invention relates to a display apparatus. Specifically, a display apparatus for retaining and displaying an item in a retail environment.

2. Background

Retail stores and other establishments often possess items that are desired to be displayed to those who would view the items, for example, shoppers. These items may be displayed for a variety of reasons, such as, for example, being offered for sale, presented for their aesthetic characteristics, presented as memorabilia or collectables, other reasons, or a combination of such reasons. In displaying an item, it is often important to the displayer that viewers can achieve a full appreciation of the displayed item, unencumbered by extraneous devices, mechanisms, and the like used to effect display of the item. To this end, conventional display techniques, such as, for example, clamshell-type packaging and hang tabs attached to items via adhesive or the like can obstruct the view of the item being displayed by including, for example, contours, seams, and residue that obfuscate optimal display of the item.

Conventional display techniques can also include a significant potential for sub-optimal display due to improper alignment and improper orientation of devices, mechanisms, and the like used to effect display of the item, with respect to the item. For example, a hang tab attached to an item via adhesive must be properly aligned with the item in order to display the item as desired when the item is hung via the hang tab. If the hang tab is improperly aligned the item may hang at an undesirable angle, or may face an undesirable direction. Moreover, if the item is improperly oriented with respect to the hang tab when the hang tab is applied to the item via adhesive, the item may be displayed at an undesirable orientation. Additionally, adhesive may be unreliable in that it may exhibit inconsistent adhesion characteristics depending on its environment. For instance, adhesive in a warmer environment may be pliable and may allow for undesirable movement between an item and hang tab, such that even precise initial positioning of the hang tab on the item cannot be relied upon when adhering the hand tab to the item. Thus even if the item and hang tab are properly aligned, they may not remain that way throughout a period of display.

These concerns are increased when multiple similar items are displayed together, as variances in alignment and orientation among the items will be more apparent to a viewer having multiple items to compare.

If an item is displayed for sale, it may be important to the seller that the devices, mechanisms, and the like used to effect display of the item do not impede a purchaser's use and enjoyment of the item. Conventional display techniques can be frustrating and dangerous to a purchaser. For example, clamshell packaging is well-known to frustrate and endanger purchasers, by often requiring substantial effort and dangerous tools in order to be opened by the purchaser.

Conventional display techniques can also generate substantial waste. Bulky clamshell packaging is typically disposed of after a single use, as are adhesive display tabs. Such single use can be inefficient, and such waste can have a negative environmental impact by accumulating in landfills and elsewhere in the environment.

BRIEF SUMMARY

A display apparatus is provided, including an item retention wall defining a cavity, and a suspension member coupled to the item retention wall, wherein the item retention wall is configured to retain an item within the cavity by a retention seal between the item and the item retention wall.

A display system is also provided, including an item, an item retention wall defining a cavity, wherein the cavity is shaped to mate with the item, and a suspension member coupled to the item retention wall, wherein the item and the item retention wall create a retention seal therebetween when the item is mated with the cavity, such that the item is retained within the cavity.

A method of displaying an item is also provided, the method including inserting an item into a cavity defined by an item retention wall, wherein the cavity is shaped to mate with the item such that the item and the item retention wall create a retention seal therebetween, and wherein a suspension member defining an opening is coupled to the item retention wall, and hanging the item via the suspension member.

Additional features will be set forth in the description that follows, and in part will be apparent from the description, or may be learned by practice of the embodiments. Both the foregoing general description and the following detailed description are exemplary and explanatory and are intended to provide further explanation of the embodiments as claimed.

BRIEF DESCRIPTION OF THE FIGURES

The accompanying figures, which are incorporated herein, form part of the specification and illustrate exemplary embodiments of the present invention. Together with the description, the figures further serve to explain the principles of, and to enable a person skilled in the relevant art(s) to make and use, the exemplary embodiments described herein. In the drawings like reference numbers indicate identical or functionally similar elements.

DETAILED DESCRIPTION OF THE INVENTION

The present invention includes a display apparatus for displaying an item and can include a cavity for supporting and containing the item therein. The cavity may be dimensioned to allow the item to protrude from the cavity, thereby displaying at least a portion of the item unobscured by the display apparatus. Further, the cavity may be dimensioned to closely conform to the exterior of the item, so as to create a retention seal (which can be due to a suction-like effect created between conforming surfaces of the cavity and the item). The display apparatus may also include a suspension member from which the display apparatus containing the item can be suspended. The retention seal helps retain the item within the cavity while suspended for display and throughout normal handling incident to display in, for example, a retail environment. Upon application of sufficient force for a sufficient duration, the item can be removed from the display apparatus, for example upon sale of the item. The display apparatus can then be re-used by inserting another item into the cavity for display.

The following detailed description refers to the accompanying figures, which illustrate exemplary embodiments. Other embodiments are possible. Modifications can be made to the exemplary embodiments described herein without departing from the spirit and scope of the present invention. Therefore, the following detailed description is not meant to be limiting. The operation and behavior of the embodiments presented are described with the understanding that modifications and variations may be within the scope of the present invention.

Figure 1:
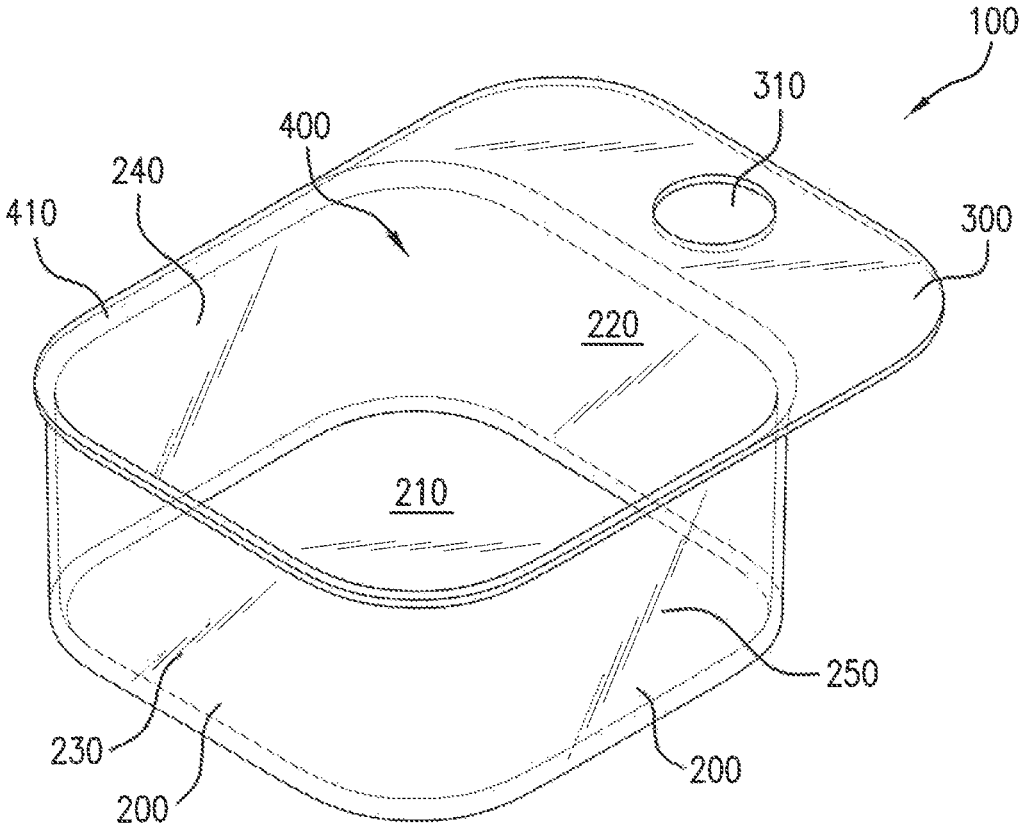
FIG. 1 is a perspective view of an exemplary embodiment of the present invention.
Figure 2:
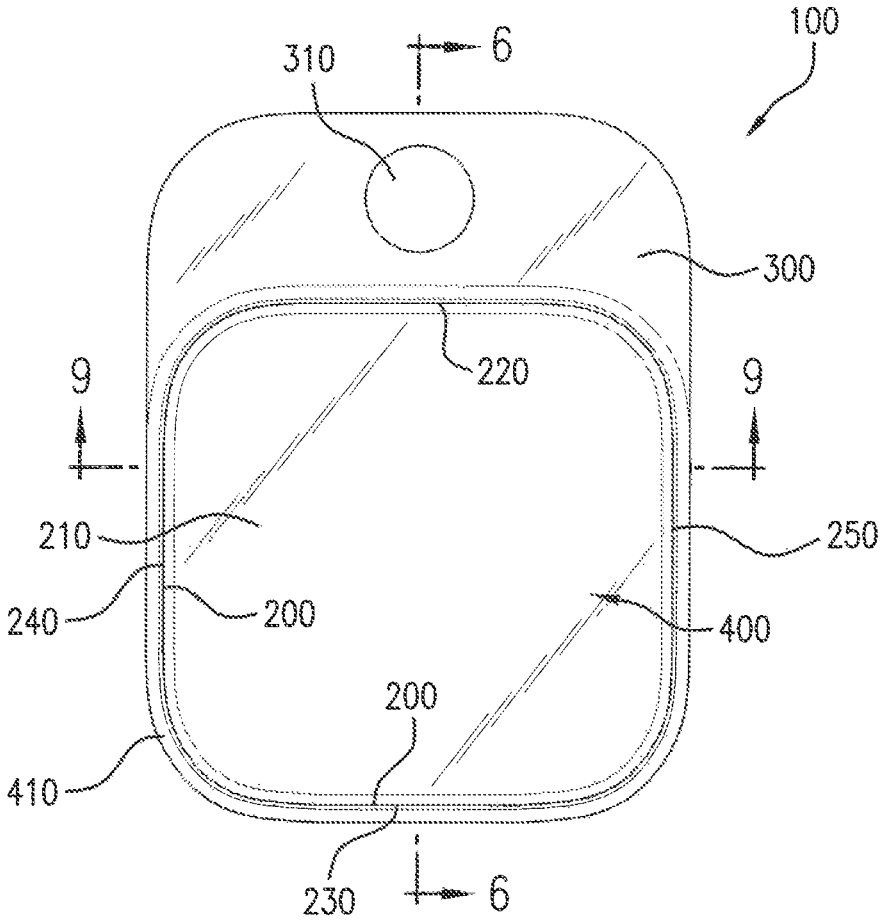
FIG. 2 is a front view of the embodiment of FIG. 1.
Figure 3:
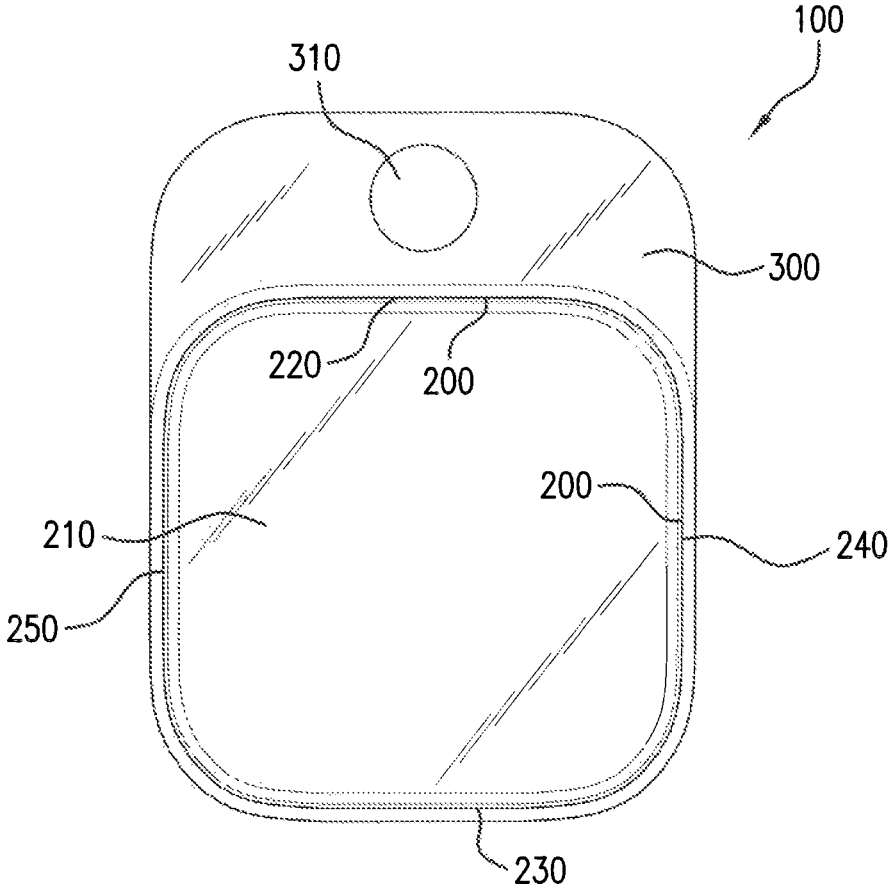
FIG. 3 is a rear view of the embodiment of FIG. 1.
Figure 4:
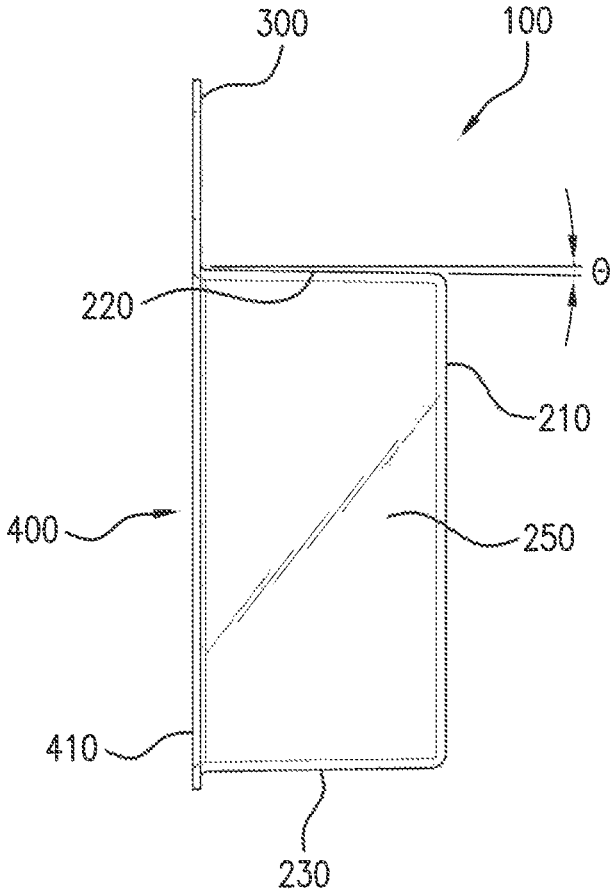
FIG. 4 is a side view of the embodiment of FIG. 1.
Figure 5:
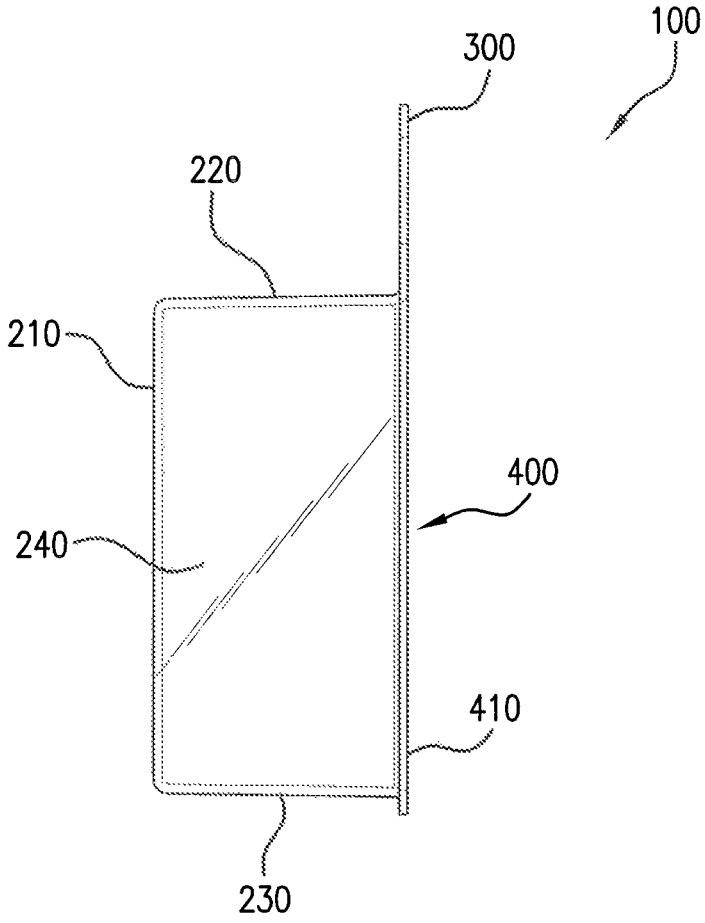
FIG. 5 is an opposite side view of the embodiment of FIG. 1.
Figure 6:
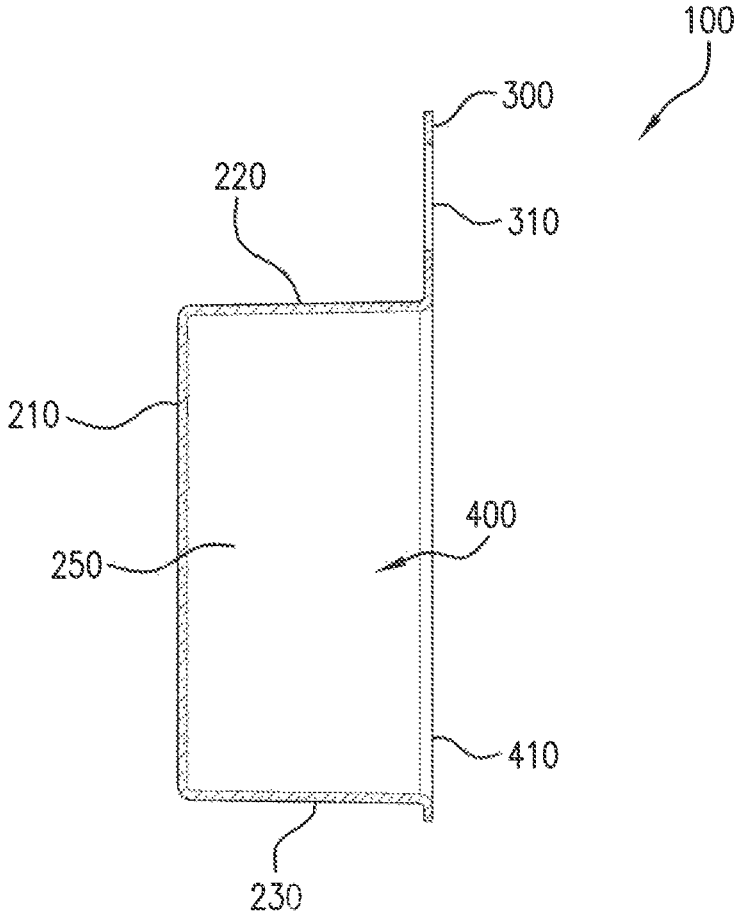
FIG. 6 is a cross-sectional view taken along line 6-6 of FIG. 2.
Figure 7:
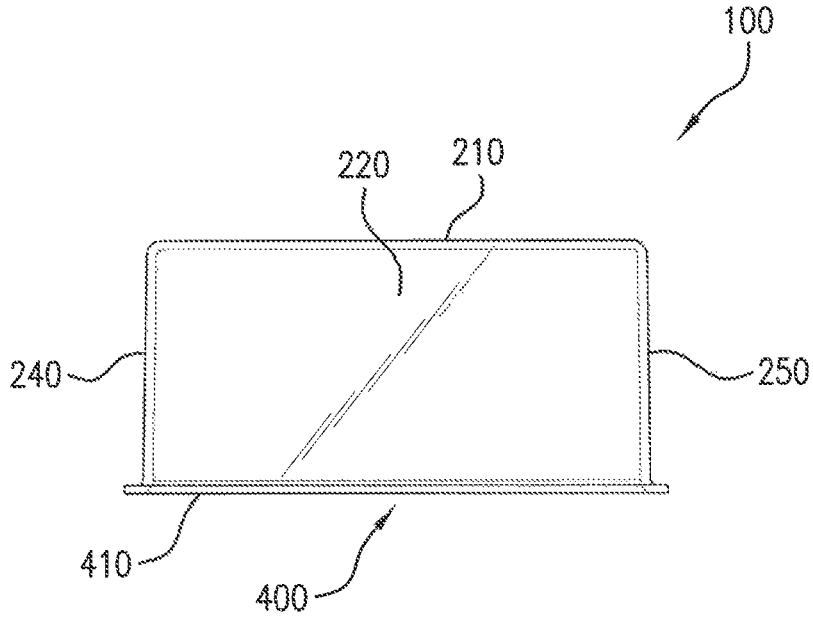
FIG. 7 is a top view of the embodiment of FIG. 1.
Figure 8:
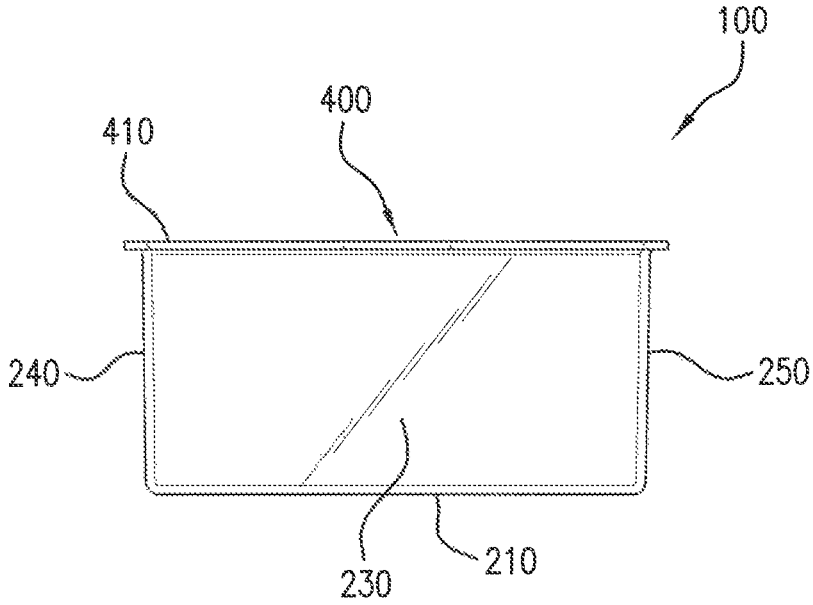
FIG. 8 is a bottom view of the embodiment of FIG. 1.
Figure 9:
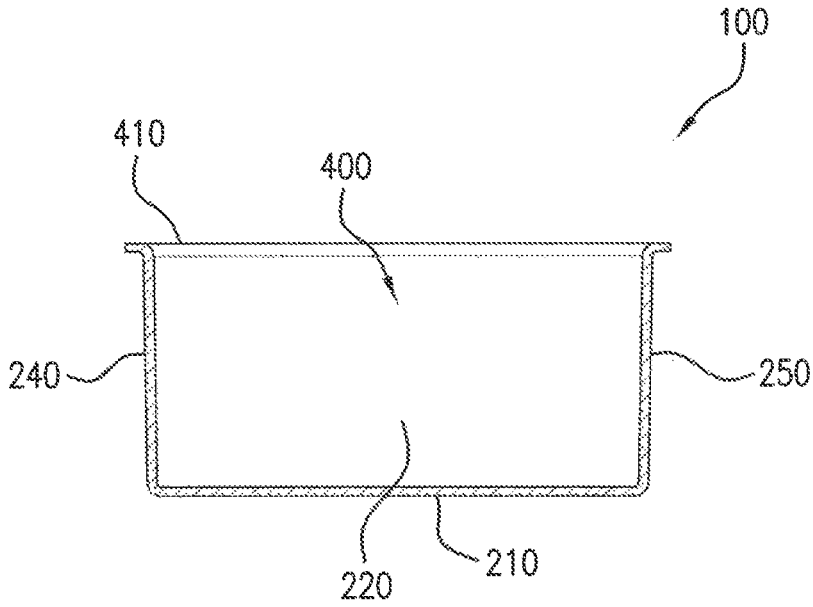
FIG. 9 is a cross-sectional view taken along line 9-9 of FIG. 2.
Figure 10:
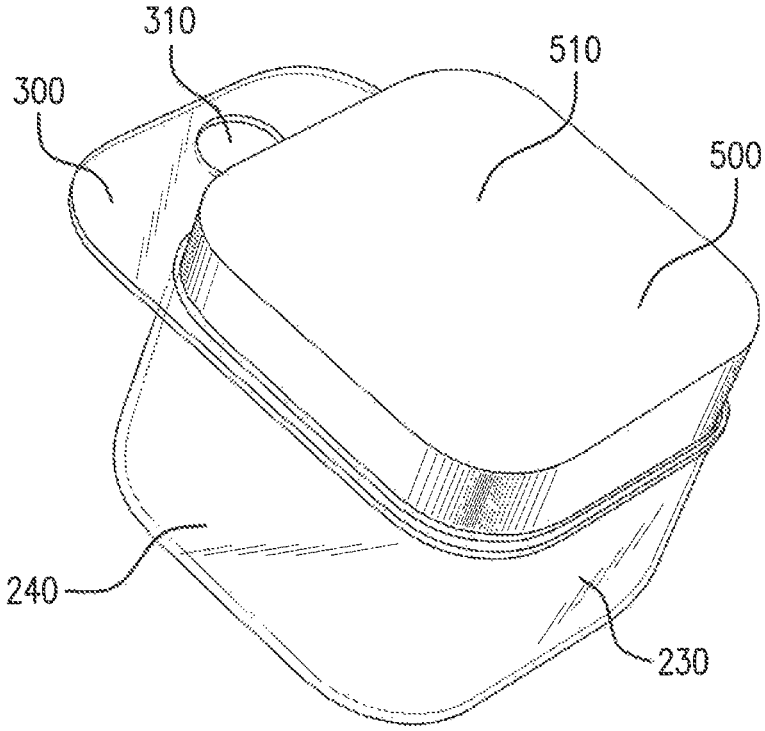
FIG. 10 is a perspective view of the embodiment of FIG. 1 including an associated item.
Figure 11:
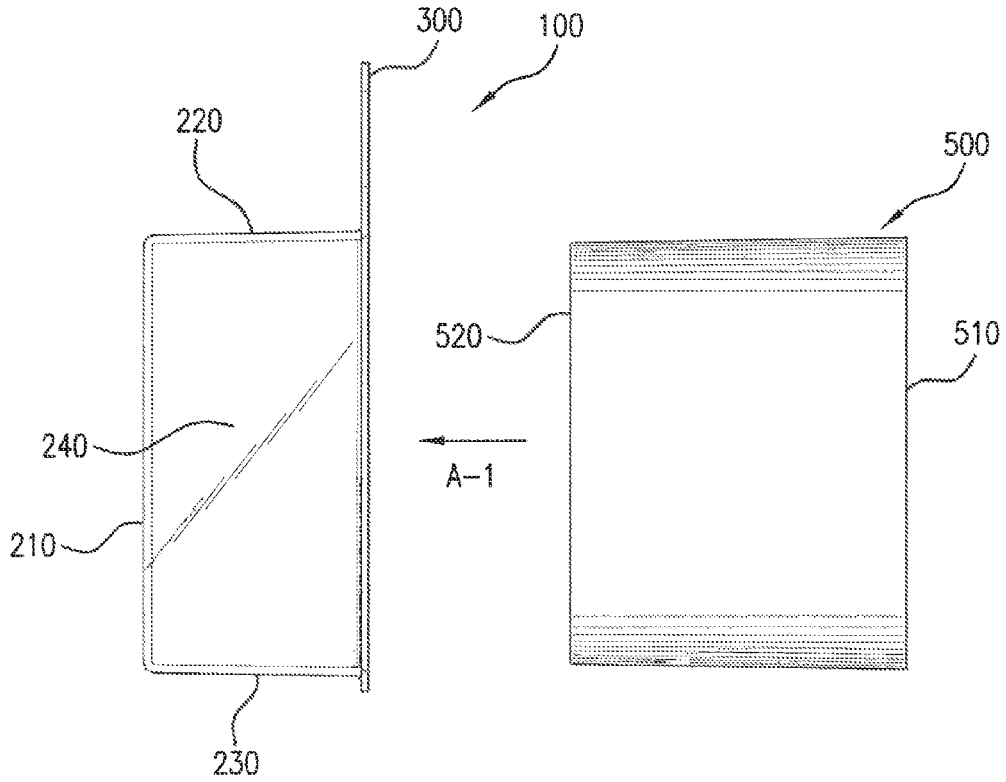
FIG. 11 is a side view of FIG. 10, depicting a loading operation.
Figure 12:
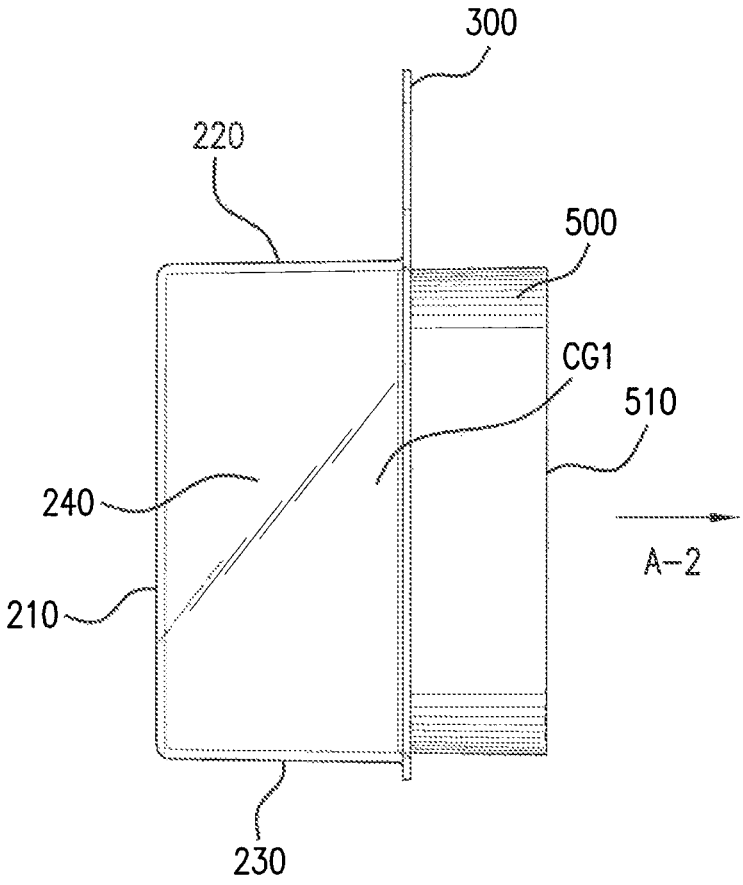
FIG. 12 is another side view FIG. 10, depicting the item as loaded.

FIG. 1 depicts a display apparatus 100 according to an exemplary embodiment of the present invention. FIGS. 2-9 depict various views of display apparatus 100. FIG. 10 depicts display apparatus 100 loaded with an item 500. FIG. 11 depicts a loading operation of display apparatus 100 with item 500. FIG. 12 depicts item 500 retained by display apparatus 100. Display apparatus 100 may be a monolithic form and includes an item retention wall 200, a suspension member 300, and a cavity 400.

Display apparatus 100 can be used to display an item (such as item 500, which can be, for example, a product itself or a product including packaging therefor) in, for example, a retail setting. Display apparatus 100 can include retention characteristics, discussed in detail below, that enable display apparatus 100 to retain an item within cavity 400 during normal use. In a retail setting, normal use may encompass not only display of an item, but handling of display apparatus 100 loaded with the item by a consumer interested in the item, inadvertent dropping of display apparatus 100 loaded with the item, and transfer of possession, for example, between a retail store employee and a consumer in the event the consumer wants to buy the item.

Cavity 400 is defined by an interior surface of item retention wall 200. Item retention wall 200 (and thus cavity 400) can be formed in a variety of shapes and sizes, including, for example, the rectangular cuboidal shape shown, a cylindrical shape, a conical shape, or an irregular shape. Such an irregular shape may include, for example, a shape having variously-shaped surfaces, such as, for example, a hexagonal surface, a circular surface, a triangular surface, a surface defined by curves of varying degree, a polygonal surface, or any combination thereof. For example, item retention wall 200 can be configured to mate with an exterior surface of item 500, in that an interior surface of item retention wall 200 may be shaped so as to conform to an exterior surface of item 500 (see FIG. 10). Item 500 may be, for example, any of the packaging disclosed in U.S. patent application Ser. Nos. 29/368,992, filed Aug. 31, 2010, and 29/369,022, filed Sep. 1, 2010, each of which is incorporated in its entirety by reference thereto. Such conformance between the exterior surface of item 500 and the interior surface of item retention wall 200 affects the retention of item 500 within cavity 400, as will be described below. In addition, such conformance may facilitate proper orientation of item 500 within cavity 400. For instance, in the case that item retention wall 200 and item 500 have corresponding draft angles, a user inserting item 500 into cavity 400 will be informed as to which portion of item 500 is to be inserted into cavity 400, by aligning the draft angles. Conformance between the exterior surface of item 500 and the interior surface of item retention wall 200 need not be exact, as variance due to design or manufacturing can be tolerated while still accomplishing desired item retention. To further aid in such insertion, item retention wall 200 may have a rounded edge along the periphery of the opening 410 of cavity 400, in order to guide item 500 into place during insertion.

In some embodiments, item retention wall 200 includes multiple wall portions, including rear wall portion 210 and side wall portions including top wall portion 220, bottom wall portion 230, first side wall portion 240, and second side wall portion 250. Side wall portions may be integral with one another and with rear wall portion 210, and may extend substantially perpendicularly from rear wall portion 210 to form cavity 400. At least a portion of at least one of top wall portion 220, bottom wall portion 230, first side wall portion 240, and second side wall portion 250 may be integral with suspension member 300 and may extend substantially perpendicularly from suspension member 300. Such designation and configuration of portions and suspension member are exemplary and are provided for convenience to aid in description and depiction. As one of skill in the art would recognize, item retention wall 200 may include more or fewer wall portions, and wall portions of item retention wall 200 may be designated and configured differently. For example, item retention wall may not include a rear wall portion, but may only include side wall portions configured to surround side walls of an item. Alternatively or additionally side wall portions need not have similar dimensions, but may have similar dimensions. Alternatively or additionally one or more side wall portions may include one or more cut-outs in order to accommodate an item including protrusions that can extend through the cut-outs. Alternatively or additionally side wall portions may include one set of opposing side walls configured to be flush with a front surface of an item when in the cavity, and another set of opposing side walls configured to be recessed thereby exposing a portion of the item.

To effect display of item 500, item 500 may be inserted into cavity 400 of display apparatus 100. Item 500 need not necessarily be fully inserted into cavity 400, and may protrude from cavity 400, as depicted in FIG. 11, for example. A portion of item 500 may be received by cavity 400 in the case that such portion of item 500 is inserted therein in the direction of arrow A-1. Given that item retention wall 200 is shaped to mate with item 500, such insertion of item 500 into cavity 400 displaces air (or other gas or liquid) that would otherwise exist within cavity 400. The amount of air displaced may vary depending on the configurations of item retention wall 200 and item 500. In some embodiments, the amount of air displaced is an amount sufficient to create a retention seal between the exterior surface of item 500 and the interior surface of item retention wall 200. In some embodiments, cavity 400 is dimensioned such that item 500 protrudes from cavity 400 when item 500 is fully inserted within cavity 400 (see, e.g., FIGS. 11 and 12). This may be beneficial, for example, in the case that item 500 is transparent packaging containing a product placed forward such that it appears to be floating within the packaging, such as the packaging and item contained therein disclosed in either of U.S. patent application Ser. Nos. 29/368,992, and 29/369,022.

A retention seal is a phenomenon by which item 500 is retained within cavity 400 even when subjected to forces incident to normal use and handling, including forces that would cause item 500 to decouple, or be removed, from display apparatus 100 in the absence of the retention seal. The retention seal can be created by the displacement of air within cavity 400 upon insertion of item 500, as indicated above.

Because of the mating configuration of the exterior surface of item 500 and the interior surface of item retention wall 200, once item 500 has been inserted into display apparatus 100, as depicted in FIG. 12, reintroduction of air into cavity 400 is limited by the proximity of mating surfaces of item retention wall 200 and item 500. Item retention wall is shaped so as to limit the reintroduction of air to such an extent that item 500 resists being removed from cavity 400. In other words, item 500 resists movement relative to display apparatus 100 in the direction of arrow A-2.

Such resistance to movement is due to a suction-like effect created between mating surfaces of item retention wall 200 and item 500. Because reintroduction of air into cavity 400 is limited, a force acting on item 500 in the direction of arrow A-2, relative to display apparatus 100, may create a pressure differential between the air pressure outside the mating surfaces of item retention wall 200 and item 500 (which may be, for example, air at an atmospheric pressure), and the air pressure between the mating surfaces of item retention wall 200 and item 500. Thus, in order to avoid such a pressure differential and to tend toward equilibrium, item 500 may resist such a force, creating a retention seal.

Air flow from an area outside the mating surfaces of item retention wall 200 and item 500 to between item retention wall 200 and item 500 (and thus to within cavity 400) may not be totally inhibited, such that removal of item 500 from cavity 400 is possible. Such removal may be accomplished by applying sufficient force on item 500 relative to display apparatus 100 in the direction of arrow A-2, for a sufficient period of time, during which air may enter cavity 400 via the periphery of item 500. Alternatively, a small pilot hole or the like may be included in item retention wall 200 to control the air flow as desired. The amount of force and period of time necessary in order to remove item 500 from cavity 400 can be varied and optimized as desired, and can depend on factors such as, for example, proximity of the exterior surface of item 500 to the interior surface of item retention wall 200, the surface area of mating surfaces of item 500 and item retention wall 200, the degree of conformance of mating surfaces of item 500 and item retention wall 200, the shape of mating surfaces of item 500 and item retention wall 200, the surface characteristics of item 500 and item retention wall 200, and the nature of the materials from which item 500 and item retention wall 200 are formed.

The above and other parameters (or "retention characteristics") can be varied in order to achieve retention having desired characteristics, which will affect both the effectiveness of retention of item 500 within cavity 400 and the nature of effective removal of item 500 from cavity 400. For example, the distance or distances between the exterior surface of item 500 and the interior surface of item retention wall 200 can be varied, generally achieving stronger retention (i.e., greater resistance to removal of item 500 from cavity 400) with a smaller distance. The surface area of mating surfaces of item 500 and item retention wall 200 can be varied, potentially achieving stronger retention with a greater mating surface area, though this will be impacted by the shape of mating surfaces as well. The shape of mating surfaces of item 500 and item retention wall 200 can be varied, generally achieving stronger retention with greater depth and with more gradual directional changes around the periphery. The degree of conformance of mating surfaces of item 500 and item retention wall 200 can be varied, generally achieving stronger retention with a greater degree of conformance. The surface characteristics of item 500 and item retention wall 200 can be varied, generally requiring greater force to remove item 500 from cavity 400 with surfaces having higher coefficients of friction. Higher coefficients of friction may also require more accurate alignment of item 500 relative to item retention wall 200 to facilitate removal. The coefficient of friction between item 500 and item retention wall 200, as well as the distance or distances between the exterior surface of item 500 and the interior surface of item retention wall 200 can be adjusted to achieve friction coupling between item 500 and item retention wall 200. Friction coupling occurs when item 500 is retained due at least to friction between item 500 and item retention wall 200, but is still removable from item retention wall 200 upon application of sufficient force.

Depending on the retention characteristics, item 500 may be able to be retained by display apparatus 100 even though cavity 400 only mates with a portion of item 500. Such a configuration may be desirable in order to more clearly display portions of item 500 not within cavity 400. For instance, if a front surface 510 of item 500 is desired to be displayed most prominently, the rear surface 520 of item 500 may be configured to be received into cavity 400, thereby allowing display apparatus 100 to retain item 500 while leaving the front surface 510 of item 500 unobscured. Moreover, item 500 need not necessarily be fully inserted into cavity 400, and may protrude from cavity 400, as depicted in FIG. 11, for example.

The nature of the materials from which item 500 and item retention wall 200 are formed can be varied. For example, item retention wall 200 can be formed of a variety of materials having varying deformation characteristics. Deformability can be optimized according to the particular application. Some level of deformability may achieve stronger retention, by increasing the ability of item retention wall 200 to conform to item 500, however too much deformability may prevent formation of the pressure differential described above, as the item retention wall may simply invert itself in response to a force tending to remove the item from the cavity. Deformability can also be affected by dimensional characteristics, such as thickness of item retention wall 200.

As an example, display apparatus 100, including item retention wall 200, may be formed of polyethylene terephthalate (PET), and may be formed integrally with suspension member 300, thereby resulting in a monolithic structure of display apparatus 100. The PET that forms display apparatus 100 may be of varying thicknesses, including, for example, thicknesses in the range of 0.1 mm to 0.8 mm.

In use display apparatus 100 may be loaded with item 500 and may be hung via an opening in suspension member 300, such as hole 310. As also described above, item 500 may be retained within cavity 400 of display apparatus 100 through a retention seal. Because the retention seal may rely on pressure differentials, and because air flow from an area outside the mating surfaces of item retention wall 200 and item 500 to between item retention wall 200 and item 500 (and thus to within cavity 400) may not be totally inhibited, it may be desirable to limit the affect of gravity insofar as it may undesirably tend toward removal of item 500 from within cavity 400 while item 500 is being displayed by display apparatus 100. To accomplish this, display apparatus 100 may be configured to include a wall portion of item retention wall 200 that is below a point proximate to the center of gravity of item 500 and display apparatus 100 together when displayed in a loaded configuration hung via hole 310, or that is proximate to a plane passing through the center of gravity and oriented to be normal to the direction of insertion of item 500 into cavity 400. For example, FIG. 12 depicts display apparatus 100 loaded with item 500 and suspended from hole 310. In such a configuration, bottom wall portion 230 extends proximate to a position below the center of gravity of item 500 and display apparatus 100 together (indicated by CG1 in FIG. 12). It is not necessary, however, that a wall portion of item retention wall 200 be directly below the center of gravity of item 500 when displayed, or that it overlap with the plane described above. Depending on other retention characteristics of display apparatus 100, the center of gravity of item 500 and display apparatus 100 together may be positioned outside the bounds of cavity 400, and display apparatus 100 may still effectively retain item 500. Positioning the center of gravity of item 500 and display apparatus 100 closer to or further within cavity 400 may, however, generally tend to improve retention of item 500 in normal use.

The position of the center of gravity of item 500 and display apparatus 100 together relative to the configuration of display apparatus 100 implicates characteristics of display apparatus 100 other than retention characteristics. For example, the position of the center of gravity relative to hole 310 in suspension member 300 may dictate the angle at which display apparatus 100 will hang when loaded with item 500. As such, the angle at which item 500 is displayed may be affected.

In order to achieve desirable characteristics at least with respect to item retention and item display, display apparatus 100 may be formed of any suitable material as would be appreciated by one of skill in the art, such as, for example, PET or aluminum, and may have any suitable wall thickness, such as, for example, 0.1 mm to 0.8 mm. Display apparatus 100 may have any suitable height, such as, for example, 70.3 mm or 79.1 mm, and may have any suitable width, such as, for example, 51.6 mm or 59.9 mm. Display apparatus 100 may have any suitable depth, such as, for example, 25.8 mm or 27.6 mm. Cavity 400 may have any suitable height, such as, for example, 47.6 mm or 56.0 mm, measured centrally at an opening side of cavity 400. Cavity 400 may have any suitable width, such as, for example, 47.6 mm or 56.0 mm, measured centrally at an opening side of cavity 400. Hole 310 may be positioned at any suitable position in suspension member 300, such as, for example, centrally. Hole 310 may be of any suitable diameter, such as, for example, 11.5 mm. Display apparatus 100 may include any suitable draft angle θ, such as, for example 0.25 degrees to 8 degrees (see FIG. 4).

Display apparatus 100 may be formed through a variety of processes, including, for example, machining or thermoforming. The suitability of any particular manufacturing process may be influenced by the desired retention characteristics, as described above. In some embodiments, display apparatus 100 is formed from a flat sheet of PET stock. The PET stock may be heated and drawn into a vacuum mold in a thermoforming process in order to form cavity 400. In order to facilitate production in this manner, surfaces of display apparatus 100 may include a draft angle θ, which may be, for example, 0.25 to 3 degrees. Hole 310 may be created by a punch operation. Due to the nature of the thermoforming process, display apparatus 100 may not have a constant thickness. For instance, rear wall portion 210 may be thinner than suspension member 300, and the thickness of rear wall portion 210 may be dependent on the depth of cavity 400.

Display apparatus 100 may be transparent, translucent, opaque, or any combination or degree thereof. Display apparatus 100 may be colored or tinted, and may include design elements such as, for example, graphics or print molded into display apparatus 100, deposited or printed thereon, or etched into the surface thereof. Transparency may be desirable in order to more fully display item 500. Opacity may be desirable in order to hide an interior of display apparatus 100 or to hide a portion of item 500. Color or design or lack thereof may be desirable to impact aesthetic appeal. Graphics or print may be desirable in order to convey information about item 500 or to impact aesthetic appeal. Alternatively or additionally, a technique such as, for example, physical vapor deposition may be used to achieve a desired surface appearance, such as, for example, a mirrored look. Such technique may be used on only a portion of display apparatus 100 or over the entire surface of display apparatus 100 in order to achieve a desired look.

The retention characteristics of display apparatus 100 described above allow display apparatus 100 to retain item 500 within cavity 400 throughout the course of normal use. For example, in a retail setting, display apparatus 100 can be hung by hole 310, for example from an elongated member of a display structure, a string, or the like, in order to display item 500. Display apparatus 100 may also retain item 500 within cavity 400 while display apparatus 100 loaded with item 500 is handled by a consumer interested in item 500, while display apparatus 100 loaded with item 500 is inadvertently dropped, and while transfer of possession takes place, for example, between a retail store employee and a consumer in the event the consumer wants to buy the item.

In use a user such as, for example, a retail store employee, may have a supply of display apparatuses 100 and a supply of items 500. The employee may orient an item 500 to correspond with the interior surface of item retention wall 200, and may insert item 500 into cavity 400, such as by a sliding motion, for example. When item 500 is fully engaged with display apparatus 100 (i.e., when the exterior surface of item 500 mates with the interior surface of item retention wall 200), item 500 will be retained within cavity 400 of display apparatus 100. The employee may then display item 500 by, for example, hanging display apparatus 100 (retaining item 500) from hole 310. The employee may, for example, position display apparatus 100 such that an elongated member of a display structure extends through hole 310, thereby supporting display apparatus 100 and item 500 in a desired manner. The employee may repeat this process with additional display apparatuses 100 and items 500 if desired, for example in order to stock a display structure.

Upon seeing item 500 thus displayed, a person such as, for example, a consumer in a retail store, may desire to handle item 500 retained by display apparatus 100. Display apparatus 100 may be designed and configured such that item 500 remains retained by display apparatus 100 through such handling. The consumer may then desire to purchase item 500, in which case he or she will bring item 500 retained by display apparatus 100 to an employee in order to complete the purchase. The employee may then pull item 500 from display apparatus 100, applying sufficient force for a sufficient time in order to overcome the retention seal, thereby removing item 500 from cavity 400 of display apparatus 100. The employee may then retain display apparatus 100 for reuse.

Display apparatus 100 provides numerous advantages over conventional techniques for displaying items. Due to the conforming nature of item 500 with item retention wall 200, improper alignment or orientation of item 500 with respect to display apparatus 100 is minimized. Because display apparatus 100 can retain item 500 through interaction with only a portion of item 500, the balance of item 500 can be displayed without obstruction. Because display apparatus 100 can retain item 500 without requiring additional elements such as glue or other adhesive, a process of preparing a display is simplified. Due to the simplification of the display preparation process, display preparation may be more feasibly performed at a display site (such as a retail store) rather than at an upstream facility such as, for example, a manufacturing or distribution facility. This allows display apparatus 100 to be shipped separately from items to be displayed, such as item 500, and thus allows more freedom in shipping configurations to increase efficiency and reduce cost. Because display apparatus 100 is distinct from any dedicated packaging, display apparatus can be removed and retained by a seller of a displayed item 500. Moreover, because display apparatus 100 is not deformed or destroyed during or after use, and can be retained, display apparatus can be re-used once a first item is removed to be sold by being loaded with a second item to be displayed for sale. This increases shipping efficiency by requiring fewer display apparatuses 100 to be shipped, and is more environmentally responsible by reducing waste and requiring fewer resources be expended in the display of items.

The embodiments described above are exemplary only. As one of skill in the art would appreciate, the present invention can be embodied in various alternative embodiments without departing from the spirit and scope of the present invention. For example, in some embodiments additional features may be included in order to assist in retention of item 500 within cavity 400 of display apparatus 100. These additional features can include, alternatively or additionally, for example, spring detents that push inwardly on item 500 when item 500 is within cavity 400, snaps, latches, magnets, or the like. In some embodiments, detents in item retention wall 200 correspond to ridges or matching detents in item 500, such that interior bulges created in item retention wall 200 can be received by the ridges or matching detents in item 500 upon insertion of item 500 into cavity 400 of display apparatus 100. These additional features can also include, for example, the inclusion of an adhesive or other tacky substance on the interior surface of item retention wall 200 that can adhesively attach to item 500 upon insertion of item 500 into cavity 400 of display apparatus 100. This adhesive or other tacky substance can be configured to remain within cavity 400 even upon removal of item 500 from cavity 400, without depositing significant residue on item 500. These additional features can also include a crush fit interface between at least a portion of item 500 and cavity 400, thereby providing a degree of compression on the exterior surface of item 500 tending to retain item 500 within cavity 400.

Additionally, though the above embodiments have been described in the context of retention and display, the invention is not so limited. The invention also encompasses security features. Use of electronic article security (EAS) tags is common among retailers. EAS tags are typically adhered to item packaging, and, when in an active state, can be sensed by EAS tag monitors, which can emit an alarm or other signal in response to sensing an EAS tag. These EAS tag monitors are typically placed near points of ingress and egress to a retail facility. Thus, when an "active" EAS tag is removed from the retail facility, the EAS tag monitors sense the proximity of the active EAS tag and emit an alarm. EAS-tagged items will typically carry active EAS tags while within the retail facility. Upon purchase of an EAS-tagged item, however, the EAS tag is typically deactivated by a retail store employee, allowing the purchaser to exit the retail facility without setting off an alarm. This process can be simplified by attaching the EAS tag to display apparatus 100, rather than item 500. Because display apparatus 100 can be retained and reused by the retailer, there is no need to deactivate the EAS tag. Upon purchase of an item 500, the retail store employee need only remove the EAS-tagged display apparatus 100, thereby allowing the purchaser to leave the retail facility with the EAS tag-free item 500. This technique can also reduce cost by reducing the number of EAS tags required to secure a given number of items. In order to maintain visual aesthetics while using an EAS tag, display apparatus 100 may be made opaque, and the EAS tag accommodated on an interior surface of item retention wall 200, thereby hiding it from view during display of item 500. Additionally, by allowing EAS tags to be retained within the retail facility, including EAS tags on display apparatus 100 rather than item 500 reduces a phenomenon known as "tag pollution". Tag pollution occurs when, for example, EAS tags, affixed and activated prior to receipt within a retail location by a party such as, for example, a manufacturer or distributor, are used at a retail facility that does not take advantage of the EAS tag capabilities (i.e., does not use EAS tag monitors) and so does not deactivate the EAS tags at sale. These active EAS tags may set off EAS tag monitors at other retail facilities, leading to confusion and false alarms. Retaining EAS tags within the retail location reduces this possibility.

What is claimed is:

1. A display apparatus, comprising:

an item retention wall defining a cavity; and a suspension member extending perpendicularly from an edge of the item retention wall, wherein the item retention wall is configured to retain an item within the cavity by a retention seal between the item and the item retention wall, wherein the retention seal is formed due to an air pressure differential when a force tending to remove the item from the cavity is applied, and wherein the suspension member defines an opening therethrough.

2. The display apparatus of claim 1, wherein the air pressure differential is between air pressure outside mating surfaces of the item retention wall and the item and air pressure between the mating surfaces of the item retention wall and the item.

3. The display apparatus of claim 1, wherein the item retention wall comprises a side wall positioned to surround a portion of the item.

4. The display apparatus of claim 3, wherein the side wall has a thickness of between 0.1 mm and 0.8 mm.

5. The display apparatus of claim 3, wherein the item retention wall comprises a rear wall coupled to the side wall and positioned to correspond to a rear of the item.

6. The display apparatus of claim 5, wherein the rear wall has a thickness of between 0.1 mm and 0.8 mm.

7. The display apparatus of claim 1, wherein the item retention wall and the suspension member are integrally formed.

8. The display apparatus of claim 1, wherein the cavity has a draft angle that corresponds to a draft angle of the item.

9. The display system of claim 1, wherein the suspension member is positioned in a plane coincident with the center of gravity of the item when the item occupies the cavity.

10. The display system of claim 1, wherein the item retention wall is shaped so that the cavity contains the center of gravity of the item when the item occupies the cavity.

11. The display system of claim 1, wherein the suspension member is positioned in a plane offset from the center of gravity of the item when the item occupies the cavity.

12. A display apparatus, comprising:

an item retention wall comprising:

a first wall portion;

a second wall portion coupled to and disposed substantially perpendicularly to the first wall portion;

a third wall portion coupled to and disposed substantially perpendicularly to the second wall portion, and disposed substantially parallel to the first wall portion;

a fourth wall portion coupled to and disposed substantially perpendicularly to the third wall portion and the first wall portion, and disposed substantially parallel to the second wall portion; and a fifth wall portion coupled to and disposed substantially perpendicularly to the first wall portion, the second wall portion, the third wall portion, and the fourth wall portion, such that the item retention wall defines a cavity, wherein an interior surface of the cavity conforms to an exterior surface of an item such that the item retention wall retains the item by an air pressure differential between air pressure between the item and the cavity and air pressure outside the cavity when a force tending to remove the item from the cavity is applied.

13. The display apparatus of claim 12, further comprising a suspension member coupled to and disposed substantially perpendicularly to at least one of the first wall portion, the second wall portion, the third wall portion, and the fourth wall portion.

14. The display apparatus of claim 13, wherein the fifth wall portion is coupled to the first wall portion, the second wall portion, the third wall portion, and the fourth wall portion at a first edge of the first wall portion, the second wall portion, the third wall portion, and the fourth wall portion, and wherein the suspension member is coupled to at least one of the first wall portion, the second wall portion, the third wall portion, and the fourth wall portion at a second edge of the first wall portion, the second wall portion, the third wall portion, and the fourth wall portion, the second edge being disposed opposite the first edge.

15. The display apparatus of claim 14, wherein the suspension member defines a circular opening therethrough.

16. The display apparatus of claim 13, wherein the first wall portion, the second wall portion, the third wall portion, the fourth wall portion, and the fifth wall portion have a thickness of between 0.1 mm and 0.8 mm.

17. The display apparatus of claim 13, wherein the first wall portion, the second wall portion, the third wall portion, the fourth wall portion, and the fifth wall portion are monolithic.

18. A display system, comprising:

an item; and a display apparatus, the display apparatus comprising:

an item retention wall defining a cavity; and a suspension member coupled to the item retention wall, wherein the item retention wall is configured to retain the item within the cavity by a retention seal between the item and the item retention wall, wherein the item protrudes from an opening of the cavity when the item is fully inserted within the cavity, and wherein the suspension member is positioned in a plane offset from the center of gravity of the item when the item occupies the cavity.

19. The display apparatus of claim 1, wherein the item retention wall and the suspension member are integrally formed, wherein the suspension member comprises a tab extending perpendicularly from an edge of the item retention wall, and wherein the suspension member defines an opening therethrough.

* * * * *